United States Patent [19]

Schmidt

[11] Patent Number: 4,589,825

[45] Date of Patent: May 20, 1986

[54] HIGH-PRESSURE CLEANING UNIT WITH A BYPASS VALVE

[75] Inventor: Jorgen Schmidt, Hadsund, Denmark

[73] Assignee: Knud Erik Westergaard, Hadsund, Denmark

[21] Appl. No.: 673,887

[22] Filed: Nov. 21, 1984

[30] Foreign Application Priority Data

Nov. 25, 1983 [DK] Denmark ..... 5388/83

[51] Int. Cl.[4] ..... F04B 49/02; F04B 49/08

[52] U.S. Cl. ..... 417/290; 417/307

[58] Field of Search ..... 417/290, 307

[56] References Cited

U.S. PATENT DOCUMENTS

| | | | |
|---|---|---|---|
| 2,172,751 | 9/1939 | Heinrich | 417/290 |
| 2,313,351 | 3/1943 | Magnuson | 417/307 |
| 2,573,864 | 11/1951 | Moran | 417/290 |
| 2,971,464 | 2/1961 | Stevens | 417/290 X |

FOREIGN PATENT DOCUMENTS

| | | | |
|---|---|---|---|
| 634803 | 3/1950 | United Kingdom | 417/290 |

*Primary Examiner*—Richard E. Gluck
*Attorney, Agent, or Firm*—Felfe & Lynch

[57] ABSTRACT

In operating high-pressure cleaning units, the outflow of the water discharged from the associated pump (6,8) may be temporarily interrupted. As the pump normally operates continuously, care must be taken to ensure that the water can then be returned in a bypass to the pump's suction side. This can be achieved by a bypass valve sensing a rising pressure in the said closing situation, thus opening for the bypass. Correspondingly, the bypass valve (36,44,32) senses a declining pressure when the discharge or ejection is resumed, thus causing a block to the bypass (40). However, a corresponding, declining pressure occurs when the pump is stopped, for which reason the bypass valve will block the bypass also in this condition. Thus, the result is that during the stopping process determined by the pump's inertia a substantial and dangerous pressure may build up in the discharge conduit (26) from the pump. The invention eliminates this pressure build-up by the bypass valve (36,44,32) being designed to respond to a pressure decline with such a time delay (via a constriction 60) that the pump with associated motor will be essentially fully stopped after switching off the motor, prior to the bypass being closed. In practice, it is without major significance that a slight delay also occurs in this way when reconnecting full operating pressure when reopening for the discharge from the cleaning unit.

2 Claims, 1 Drawing Figure

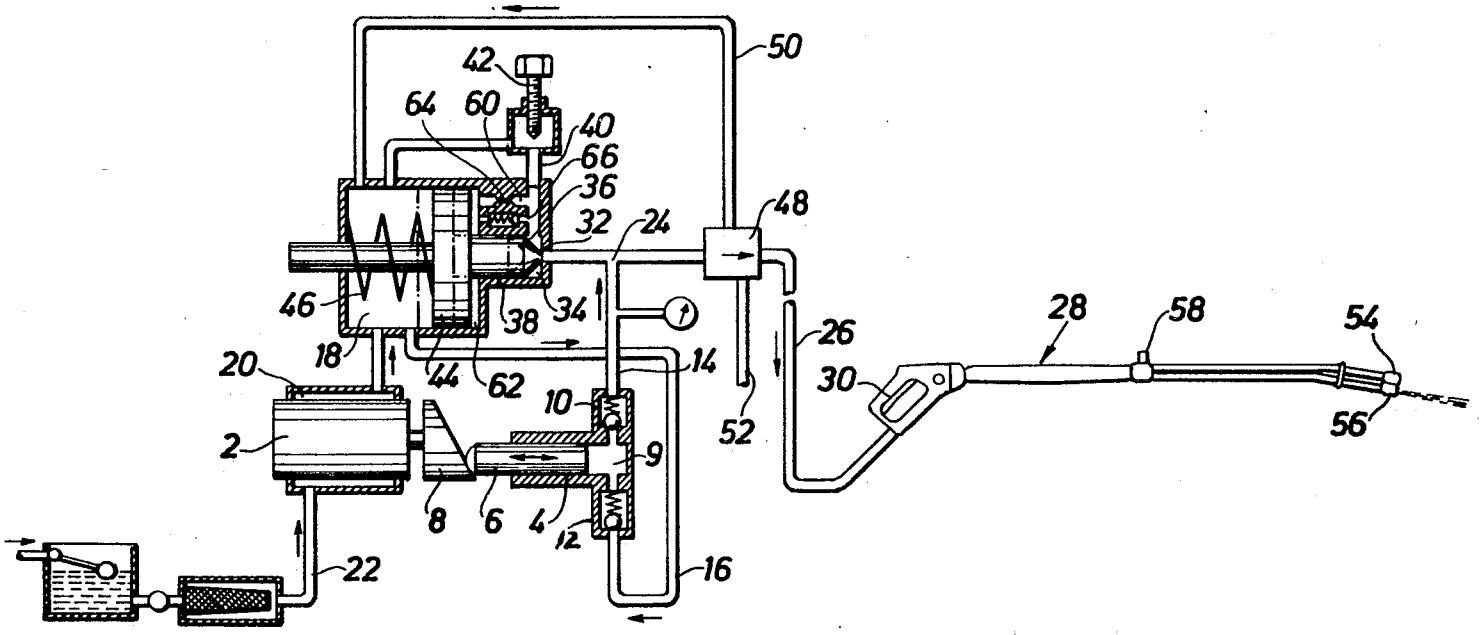
54
56
58
28
30
26
48
50
52
16
14
9
24
40
66
36
32
34
10
12
4
42
60
38
62
6
64
44
8
18
46
22
20
2

HIGH-PRESSURE CLEANING UNIT WITH A BYPASS VALVE

The present invention relates to a high-pressure cleaning unit with a positive-displacement pump and a pressure-controlled bypass valve, designed for connecting the pump to bypass condition at the pressure rise occurring when the water outlet of the high-pressure cleaning unit is shut off. Precisely when a positive-displacement pump is used for providing a high pressure, it is vital for the pump to continue delivering pump water after the ejection from the cleaning unit is shut off; it is natural that this is rendered feasible in a simple way by the water being led directly back to the inlet side of the pump. This could be achieved by the water returning through a safety valve opening at a specific positive pressure above normal operating pressure, but the associated sharp pressure drop across the safety valve would lead to rapid heating of the water to the boiling point and correspondingly high power consumption.

In practice, this problem is solved in a better way by using a special bypass valve, which is caused to open at the said additional pressure rise after closing of the ejection to allow an almost entirely unrestricted return flow of water. This means that bypassing can be made without significant heating of water and at a low power consumption, as the pressure at the pump's delivery side is reduced to a very low bypass pressure. Of course, this does not permit reopening the ejection at maximum pressure, but the bypass valve is designed in such a way that it can be reset at the reduced water discharge or the low additional pressure drop resulting when the ejection valve is reopened, e.g. a pistol valve mounted on an ejection nozzle. In making this resetting, the bypass facility is blocked, which means that the maximum operating pressure will be available anew.

This gives rise to the special problem that the bypass valve can react inexpediently in response to a special change of state, viz. when the pump is stopped with ejection disconnected, i.e. when the pump operates in bypass mode. When stopping the pump, the bypass pressure will actually start declining because the volume flow of the bypass water declines as the speed of the pump and its motor decreases. The bypass valve will register this declining pressure in the same way as the declining pressure upon reopening the ejection nozzle, i.e. the bypass valve will be caused to close for the bypass in preparation for renewed high-pressure ejection. However, the outlet will not be reopened; on the contrary, the pump will continue to run for a little while due to the remaining inertia of pump and motor until it stops, and as both outlet and bypass are closed, this may cause the build-up of a substantial pressure on the pump's delivery side, i.e. in the pressure hose leading to the ejection nozzle. This pressure may very well reach a value close to the normal operating pressure, however without reaching such a level that it activates the bypass valve. The result is that a presumably inactive high-pressure cleaning unit can resist a very high pressure in the ejection hose, meaning that in unfortunate cases, operating the ejection valve in a way that is presumed to have no effect may lead to highly dangerous water ejection from the ejection nozzle. For this reason, it is prescribed that the cleaning unit must be relieved of pressure when the pump is stopped, typically by the operator briefly opening the ejection valve upon stopping the pump.

However, such a safety precaution for operation does not per se involve any safety, and the unit should preferably be designed in such a way that it can distinguish between the two mentioned situations, thus automatically ensuring that the bypass valve is kept open when the declining pressure is due to the pump stopping, while it is closed when the pressure drop is due to the ejection valve being opened.

The object of the invention is to provide precisely such a design of the high-pressure cleaning unit.

The invention is based on the finding that providing an automatic distinction between the said two situations does not at all call for the performance of an actual distinction process, if, instead, a control criterion is used, based on the circumstance that the pump is stopped within a certain, fairly short period of time, while reactivating the bypass valve is not correspondingly time dependent. In other words, according to the invention it can be ensured that resetting the bypass valve to the bypass-blocking position can be made with a time delay, which—in the stopped condition—is sufficient to counteract the generation of any signficant pressure build-up. At the same time, the same delay is without any significant operational nuisance when starting ejection anew, precisely because the duration of the delay may be very brief.

Based on this control principle, the invention may be realized in an extremely simple way, particularly because a time delay in a hydraulic system may be generated by quite simple means, namely by the use of a constricted flow passage for inlet and/or outlet of a pressurized liquid to or from a pressurized space, in which a control pressure for a spring-loaded operating piston can then build up and/or be reduced at the desired delay.

The invention, which is defined in more detail in the patent claims, is described below in more detail with reference to the example shown on the drawing.

The drawing shows a schematic view of a high-pressure piston pump with a motor 2, a pump cylinder 4, and a pump piston 6, which is driven back and forth in cylinder 4 in cooperation with a cam body 8 driven by the motor 2. The cylinder 4 has a closed end or pump chamber 9, connecting with a pressure conduit 14 and a suction conduit 16, respectively, through pump valves 10 and 12. The suction conduit 16 connects with a cooling jacket 20 around the motor 2 through a piston cylinder 18 and from thence to a water intake 22, in the shown example connecting with a water inlet, from where the water is fed in at atmospheric pressure. The water fed to pump chamber 9 will thus pass the cooling jacket 20, thus being heated slightly.

The pressure conduit 14 leads into a discharge conduit comprising a discharge pressure pipe 24, which connects with a pressure hose 26 at its right, such hose terminating in an ejection nozzle 28 with a discharge valve 30, and ends in a valve seat 32 at its left, said seat leading into a chamber 34 and normally being kept closed by means of a conical valve body 36 embedded in a cylinder 38. A bypass conduit 40 runs from the chamber 34 through a throttle valve 42, stretching as far as to lead into the piston cylinder 18, through which the conduit 40 connects with the suction conduit 16 of the high-pressure pump. In this way, a bypass can be established from the pressure conduit 14 through the pipe 24, the chamber 34, the conduit 40, the cylinder 18, and the suction conduit 16.

A control piston 44 is embedded in the piston cylinder 18, said piston supporting the conical valve body 36 reaching into the cylinder 38. The said conical valve body acts per se as a piston in this cylinder 38. The control piston 44 is actuated by a spring 46 pressing the piston 44 towards the right, thus trying to keep the conical valve body 36 in closed position against the seat 32.

In the right-hand end of the discharge pipe 24 is shown an inserted unit 48, which has a return conduit 50 connecting with the cylinder 18 and a downwards leading conduit 52; through which additives may be added to the water flow to the nozzle 28. This unit is without special significance for the invention and will only be mentioned briefly below.

When the high-pressure pump is started, a pressure builds up in the discharge pipe 24, and the pressure thus passes a couple of characteristic stages, namely an initial medium-pressure stage equal to the delivered volume of water being ejected through a comparatively wide or open flushing nozzle 54 in the nozzle 28, and next a high-pressure stage correresponding to an actual ejection of the same volume or current of water through a narrow high-pressure nozzle 56, with a valve 58 provided in the nozzle for switching between these nozzles. If the discharge valve 30 is open, the pressure will thus increase to one of these levels. Otherwise—or when the discharge valve 30 is closed—the pressure will instantly rise additionally. This will cause it to reach an upper triggering level at which the pressure in the discharge pipe 24, which pressure in fact also acts on the end of the closed valve cone 36, will be sufficient to push this valve cone back against the effect of the spring 46.

As soon as the valve cone 36 is thus pressed away from the seat 32, the delivered water will be able to pass through the said bypass connection 24,32,40,42,18,16; the pressure will thereby drop drastically, but as it now actuates on the entire forwardly facing area of the valve cone body 36, the pressure in question—the bypass pressure—will be sufficient to next keeping the conical body in a position pressed away from seat 32. However, in this connection it is important that the bypass pressure acts not only on the end of the conical body 36, but also on the front side of the control piston 44, as a connecting duct 60 extends from the bypass conduit 40 to a chamber 62 in the shape of the adjacent end of cylinder 18 in front of the piston 44. A slightly reduced bypass pressure prevails in the cylinder 18 behind the piston 44, as the bypass water has in fact passed the throttle valve 42. The conditions are so adapted that the bypass pressure at the front of the piston system 36,44 is only just able to overcome the pressure at the back of the piston 44 plus the force deriving from the spring 46.

If one of the ejection nozzles 54 or 56 is now opened by operating the ejection valve 30, this would cause a certain larger or smaller, respectively, pressure drop in the discharge conduit 24 and hence in the chamber 34 and the chamber 62. The pressure drop will be propagated in reduced form to the rear of the control piston 44, and at the total pressure reduction and the unchanged force from the spring 46, the piston system 36,44 will be pressed forwards to close the valve seat 32. This causes an interruption of the bypass, and the pump can now build up the relevant operating pressure for ejection through the activated nozzle 54 or 56. Once the ejection valve 30 is closed again, the pressure will rise anew to the said release pressure, at which the valve seat 32 is opened for establishing a bypass with a low power consumption.

The special problem mentioned in the third opening paragraph arises when the pump motor 2 stops, while the ejection nozzle 28 is closed, i.e. when the bypass valve 32,36 is open. As a matter of fact, the immediate result of the stoppage will be that the pressure in the discharge conduit 24 will begin to decline when the pump output begins to decrease, and the by-pass system will register this presure drop in precisely the same way as the pressure drop caused by reactivation, which normally causes the bypass valve to close when the ejection valve 30 is opened, i.e. the bypass valve is closed quickly after shutting off the motor 2. Due, however, to the prevailing rotation inertia of the motor/pump system, the pump will continue to discharge a certain quantity of water, which will then generate a sharp pressure rise in the now entirely blocked discharge conduit 24. The consequent pressure build-up may very well reach nearly the normal, full operating pressure, however without entirely reaching the release pressure at which the bypass valve opens, i.e. after motor 2 stops, the high-pressure cleaning unit may be left with a very high and dangerous pressure in the entire discharge system.

In the example described here, this problem is solved in an extremely simple way, namely by the connecting channel 60 between the bypass conduit 40 and the cylinder chamber 62 being designed with a constriction 64, which delays the transmission of pressure changes from conduit 40 to the chamber 62.

The result of this is that the opened bypass valve will not close immediately upon the occurrence of a pressure drop, but only such a long time thereafter that the high-pressure pump can succeed in being essentially stopped, when the pressure drop is due to the fact that the motor 2 is shut off. It is evident that reclosing the bypass valve will be correspondingly delayed when the release pressure drop is due to reopening the discharge valve 30 while the pump is operating continuously, but the associated waiting time will not have any major significance, as it may be as brief as the brief after-running time of the pump after the pump motor 2 is shut off.

At this point, it should be stressed that upon reopening the discharge valve 30, there will not only be immaterial inconvenience due to the slightly longer reaction time for closing the bypass valve, but even an associated more important advantage, viz. that reclosing the bypass valve is done in a delayed or dampened way, thus causing the pressure build-up to operating pressure to be dampened correspondingly. This entails the ergonomic advantage that the operator does not have to resist any quite sudden reaction force from the nozzle 28 upon reopening discharge valve 30, as the operating pressure will build up gradually within a brief period of time.

There will be no associated corresponding or special advantage in the bypass valve opening at a time delay upon the occurrence of an upper release pressure, and, if desired, this opening can be made more immediate by inserting a non-return valve connection 66 between the bypass conduit 40 and the cylinder chamber 34, said valve connection permitting a pressure rise in the conduit 40 to be transmitted rapidly to the chamber 62 without permitting a corresponding transfer of a pressure drop, which has to be propagated through the constricted channel 60,64 in the desired time-delayed way.

The unit 48 contains a valve equipment for optional connection of the special bypass or return conduit 50, with a tapered nozzle placed in it, said nozzle causing the return water to be heated, a pressure markedly exceeding the aformentioned bypass pressure being maintained on the pump's delivery side, thus causing the bypass valve 36,32 to remain closed when a water-heating bypass has been established through the return conduit 50. Moreover, additive liquid may be added through the injector conduit 52 to the main flow through the unit 48. The unit 48 is described in more detail in Danish patent application No. 5390/83, filed Nov. 25, 1983, for which reason it is not described in more detail here. It should only be added that the unit, as described in the said application, is preferably a separate or externally connected unit, while in this connection it is preferably a unit incorporated in the high-pressure cleaning unit.

I claim:

1. High-pressure cleaning apparatus comprising:

a water outlet, a positive-displacement pump, a discharge conduit communicating with said water outlet and said pump, a pressure-controlled bypass valve communicating with said discharge conduit for connecting said pump to bypass condition at the pressure rise occurring when the water outlet of the high-pressure cleaning apparatus is shut off, and means for ensuring that switching said bypass valve to a bypass-blocking position occurs with a time delay for minimizing, upon stopping said pump, any pressure build-up in said discharge conduit from said pump, said bypass valve opening at a positive working pressure, said pump having a delivery side and an inlet side and said bypass valve connecting the pump's delivery side with its inlet side upon such opening, a bypass conduit, a connecting duct thereto, a cylinder having a chamber communicating with said connecting duct, a spring-loaded piston in said cylinder for controlling said bypass valve, said cylinder chamber-through said connecting duct to said bypass conduit-during steady-state condition having the water pressure prevailing in said bypass conduit, said time-delay ensuring means comprising constriction in said connecting duct, which causes said time delay by delaying the pressure change transmission from said bypass conduit to said cylinder chamber.

2. High-pressure cleaning apparatus according to claim 1, comprising a non-constricted connecting duct parallel to said connecting duct having a constriction, and a non-return valve in said non-constricted connecting duct to allow free flow from said bypass conduit to said cylinder chamber, while preventing flow in the opposite direction.

* * * * *